US005605474A

United States Patent [19]

Auclair

[11] Patent Number: 5,605,474

[45] Date of Patent: Feb. 25, 1997

[54] ELECTRICAL HARNESS

[75] Inventor: Randolph L. Auclair, New Hartford, Conn.

[73] Assignee: Electric Motion Company, Inc., Winsted, Conn.

[21] Appl. No.: 375,545

[22] Filed: Jan. 19, 1995

[51] Int. Cl.[6] ..... H01R 11/00

[52] U.S. Cl. ..... 439/505; 439/883; 24/703.6; 174/84 C

[58] Field of Search ..... 439/880, 883, 439/502, 505, 421, 422, 442, 424; 24/23 R, 23 W, 703.6; 174/84 C

[56] References Cited

U.S. PATENT DOCUMENTS

| | | | |
|---|---|---|---|
| 2,273,007 | 2/1942 | Cooper | 24/23 W |
| 2,710,435 | 6/1955 | Crosby | 24/23 W |
| 3,587,030 | 6/1971 | Ohnsorg et al. | 439/883 |
| 3,641,629 | 2/1972 | Beardsley | 24/23 W |
| 3,662,089 | 5/1972 | Harding | 174/84 C |
| 3,902,004 | 8/1975 | Harding et al. | 174/84 C |
| 3,937,403 | 2/1976 | Lawson | 439/424 |
| 4,394,533 | 7/1983 | Naito | 439/883 |
| 4,834,682 | 5/1989 | Auclair et al. | 439/883 |
| 5,160,209 | 9/1992 | Schuessler | 24/703.6 |

*Primary Examiner*—Neil Abrams
*Assistant Examiner*—Brian J. Biggi
*Attorney, Agent, or Firm*—Chilton, Alix & Van Kirk

[57] ABSTRACT

An electrical harness employs a flexible twisted wire of circular cross-section formed from a multiplicity of electrically conductive strands. Electrical connectors are secured to the wire at equidistantly spaced positions along the length of the wire. Each connector is an integral one-piece structure having a center section and two wing sections. Each connector is crimped in position by folding the wing sections over the wire such that the wire is sandwiched between the center section and the wing sections. A transverse orifice extending through the connector and the wire facilitates forming an electrical connection between a threaded terminal and the wire.

12 Claims, 3 Drawing Sheets

ELECTRICAL HARNESS

BACKGROUND OF THE INVENTION

This invention relates generally to harness conductors which are employed as mechanical and electrical connectors for bonding and grounding connections. More particularly, the present invention relates to harness conductors which employ conductive eyelets for providing electrically-conductive connections with a terminal.

Flexible braided wires of conductive material employed for providing electrical connections for grounding and similar applications are well known. It is also well known to provide openings in the braided wires for receiving a threaded fastener for connecting and securing the braids to a termination point. Electrically conductive eyelets or grommets have been mounted at the braid openings for enhancing the electrical and mechanical connection between the braid and the termination point.

In U.S. Pat. No. 4,834,682, which is assigned to the assignee of the present invention, a braided wire electrical connector employs eyelets for providing electrical connection with a termination point. Standard flexible braid has a generally rectangular shape that resists flexing in the direction of the two short sides. Eyelets for such braids must be specially tooled for multiple holes or different hole sizes. Flag-type terminals may be employed on such braids. However, such terminals can act like wrenches when pulled on and thereby loosening the connection nut.

SUMMARY OF THE INVENTION

Briefly stated, the invention in a preferred form is an electrical harness which comprises a flexible twisted wire formed from a multiplicity of electrically conductive strands. The wire has a generally uniform circular cross-section with a generally uniform diameter. Electrical connectors are secured to the wire at generally equidistantly spaced positions along the length of the wire. Each connector is an integral one-piece structure having a center section and two wing sections. Each connector is crimped in position by folding the wing sections over the wire such that the wire is sandwiched between the center section and the wing sections. A transverse orifice extending through the connector and the wire facilitates forming an electrical connection between a threaded terminal and the wire.

In a first embodiment, the connector defines a first circular orifice and two semi-circular notches. The axis of the first orifice is aligned with the axis of an aperture in the wire. The two semi-circular notches are aligned during crimping to form a second circular orifice which is substantially coaxial with the aperture.

In a second embodiment, the center and wing sections each have a plurality of slots forming a star-shaped pattern in the area occupied by the orifice and notches of the first embodiment. During crimping, a die member pushes the V-shaped portions formed by the slots into the aperture to form an interior side wall.

In a third embodiment, connectors are positioned generally equidistantly along the length of a wire and crimped in position. A die member is used to punch an orifice through the member center section, the wing sections and the wire to form an eyelet. Alternatively, the eyelet may be formed by drilling a hole through the member center section, the wing sections and the wire.

An object of the invention is to provide a new and improved electrical harness which may be manufactured and assembled in an efficient and relatively low cost manner.

Another object of the invention is to provide a new and improved electrical harness which may be flexed in any direction relative to the axis of the harness.

A further object of the invention is to provide a new and improved electrical connector which may be crimped into position on a twisted conductive wire.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
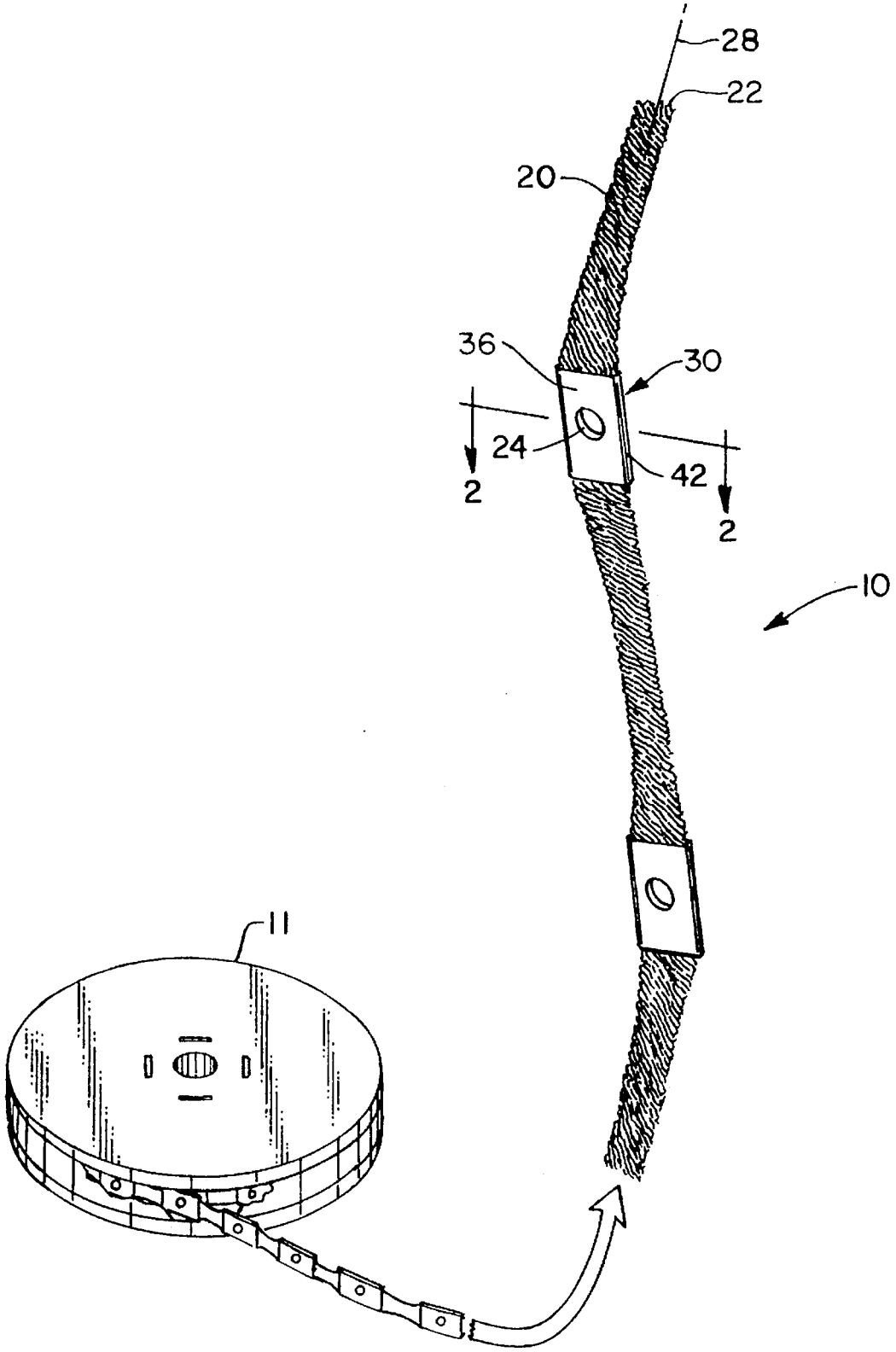
FIG. 1 is a perspective view of a portion of an electrical harness in accordance with the present invention together with a perspective view, partly in schematic, of a continuous ground connector coil.
Figure 2:
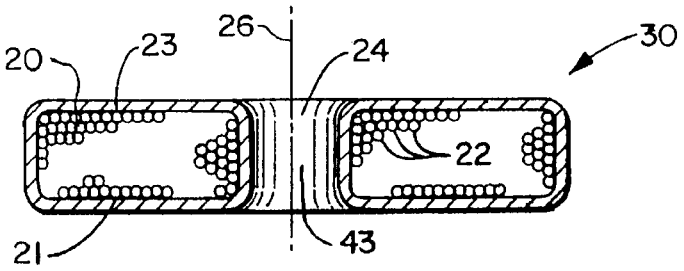
FIG. 2 is a sectional view of the electrical harness taken along the line 2—2 of FIG. 1.

With reference to the drawings wherein like numerals represent like parts throughout the several figures, an electrical harness in accordance with the present invention is generally designated by the numeral 10. The harness 10, as illustrated in FIG. 1, is a portion of a continuous coil 11 which may typically be 25 or 50 feet in length. Sections of the coil are typically cut to a given length with splice snips (not shown) in accordance with the requirements of a given application.

The electrical harness 10 preferably comprises a flexible twisted wire 20 of interwoven groups of electrically conductive wire or strands 22. The wire 20 initially has a generally uniform circular cross-section with a generally uniform diameter. In one embodiment, substantially identical apertures 24 are formed at generally equidistantly spaced positions along the length of the wire 20. The formation of the apertures 24 may result in the transverse enlargement of the width of the wire in the vicinity of the apertures. In a preferred embodiment, the centers of the apertures 24 are 3 inches apart.

An electrical connector 30 is positioned at each aperture 24 and secured to the wire 20 to facilitate an electrical connection between a threaded terminal (not shown) and the wire 20. Each connector 30 has first and second surfaces 32, 34 (FIG. 7) wherein the first surface 32 is in intimate contact with the wire 20 upon installation of the connector 30. The connector 30 has a center section 36 and two wing sections 38, 40. The connector 30 is positioned such that the connector axis 66 is parallel to the wire axis 28 and a first surface portion 21 of the wire 20 is in contact with the connector first surface 32.

Each connector 30 is an integral one-piece structure as shown in FIGS. 3 through 6. Prior to assembly with the wire 20, the connector 30 has a generally plate-like structure. Each wing section 38, 40 has a lateral edge 46, 48. The connector 30 is crimped in position at a corresponding aperture 24 by folding the wing sections 38, 40 over the wire 20 such that the wire 20 is sandwiched between the center section 36 and the wing sections 38, 40 wherein the wing section first surface 32 engages a second surface portion 23 of the wire 20. In a preferred embodiment, the wing section side edges 46, 48 will be in intimate contact. Alternatively, the wing section side edges 46, 48 may be in close proximity. Side wall sections 42 intermediate the center section 36 and the wing sections 38, 40 are formed during crimping. In one embodiment, the connector 30 has a length of 0.75 inches, the center section 36 has a width of 0.5 inches, each wing section 38, 40 has a width of 0.25 inches, the side wall sections 42 have a width of 0.0625 inches and the orifice has a diameter of 0.25 inches.

Figure 3:
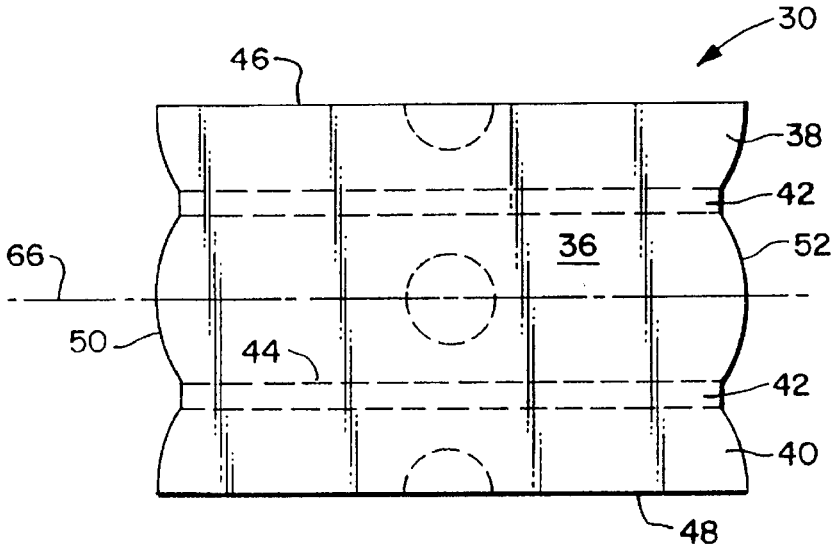
FIG. 3 is a top plan view of a first embodiment of a connector of FIG. 1.
Figure 4:
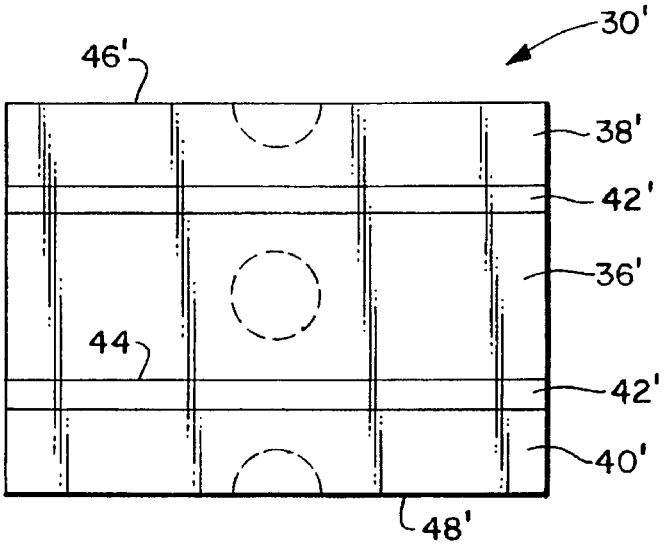
FIG. 4 is a top plan view of an alternate embodiment of the connector of FIG. 3.

In the embodiment shown in FIG. 3, the leading and trailing edges 50, 52 of the connector 30 have been shaped to define the center section 36, first and second wing sections 38, 40, and the side wall sections 42. The reduced metal mass of the side wall sections 42 provides less resistance to a bending moment, causing the connector 30 to bend at the side wall sections 42 when the connector 30 is crimped. Alternatively, a score 44 may be used to define the location of the side wall sections 42, as shown in FIG. 4.

It will be appreciated that the foregoing crimp connection can be accomplished in an efficient manner wherein the cross-sectional area of the wire 20 is greatly reduced with the voids being nearly eliminated through the resulting metal flow of the conductive wires and the connector. The crimping action causes the wire strands 22 and connector 30 to essentially cold flow into a solid, rectangular mass creating a connection of high electrical conductivity and high mechanical pull-out strength. The resulting electrical connection is highly resistant to mechanical vibration and corrosion. The lengths of wire located between the connectors retain their generally uniform circular cross-section and may be flexed in any direction.

Figure 5:
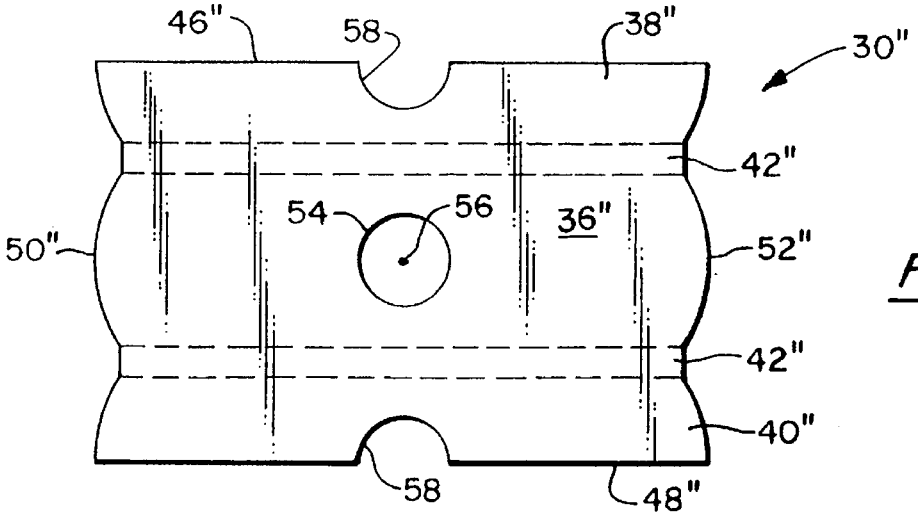
FIG. 5 is a top plan view of an alternate embodiment of the connector of FIG. 3.
Figure 8:
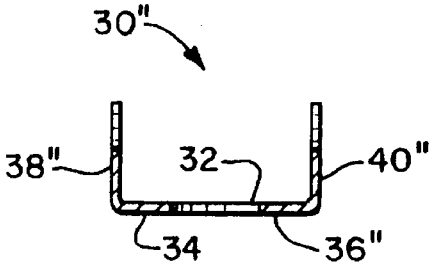
FIG. 8 is a sectional view of the connector of FIG. 5 wherein the first and second wing portions extend upwardly relative to the connector first surface.

In an embodiment shown in FIG. 5, the connector 30" defines a first circular orifice 54 and two semi-circular notches 58. The axis 56 of the first orifice 54 is aligned with the axis 26 of the aperture 24 prior to crimping. The two semi-circular notches 58 are aligned during crimping to thereby form a second circular orifice which is substantially coaxial with the aperture 24. The connector 30" may be bent prior to positioning, as shown in FIG. 8, to facilitate aligning the connector 30" with the aperture 24.

The aperture 24 and orifice 54 are centered in the wire 20 and connector 30, eliminating the wrench-effect that flag-type terminals are subject to. The connector 30 may be extended in length to accommodate a plurality of apertures 24 where multiple holes are required.

Figure 6:
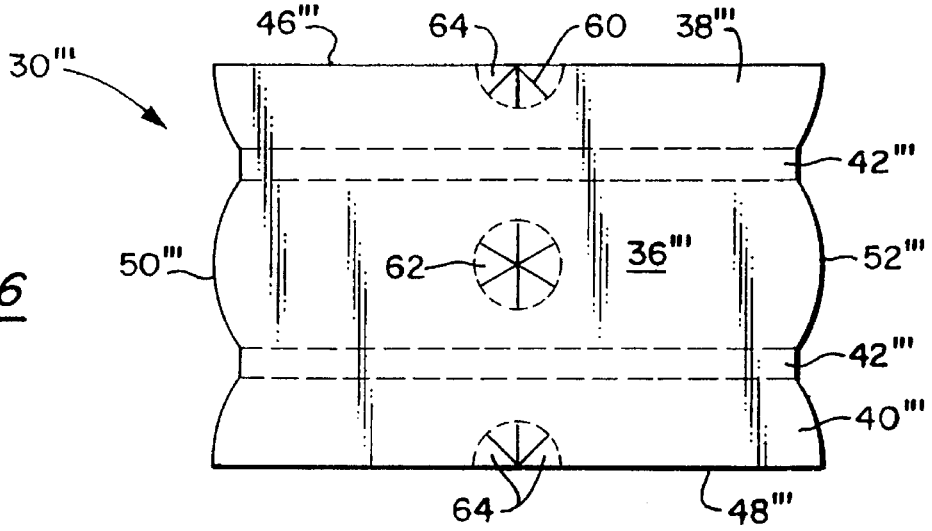
FIG. 6 is a top plan view of an alternate embodiment of the connector of FIG. 3.
Figure 7:
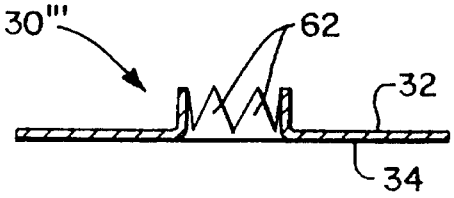
FIG. 7 is a sectional view of the connector of FIG. 6 wherein the tangs of the connector center section extend upwardly relative to the connector first surface.

In an embodiment shown in FIG. 6, the center and wing sections 36''', 38''', 40''' each have a plurality of slots 60 forming a star-shaped pattern in the area occupied by the orifice and notches of the embodiment of FIG. 5. During crimping, a die member (not shown) pushes the V-shaped tangs 62, 64 formed by the slots 60 into the aperture 24 to form an interior side wall 43. Alternatively, the V-shaped tangs 62 formed by the slots 60 in the center portion 36''' of the connector 30''' may be pushed upwards relative to the connector first surface 32, as shown in FIG. 7, to facilitate aligning the connector 30''' with the aperture 24.

Alternatively, the connectors 30''' may be positioned equidistantly along the length of the wire 20 and crimped in position. A die member (not shown) is used to bend the V-shaped tangs 62, 64 into the wire 20, displacing the wire strands 22, thereby forming the aperture 24.

The embodiments shown in FIGS. 3 and 4 may be used where a slight reduction in the mechanical strength of the wire 20 is unimportant. Connectors 30, 30' are positioned generally equidistantly along the length of a wire 20. Each connector 30 is crimped in position by folding the wing sections 38, 40 over the wire 20 such that the wire 20 is sandwiched between the center section 36 and the wing sections 38, 40. A die member (not shown) is used to punch an orifice through the member center section 36, the wing sections 38, 40, and the wire 20 to form an eyelet. Alternatively, the eyelet may be formed by drilling a hole through the member center section 36, the wing sections 38, 40, and the wire 20.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. An electrical harness comprising:

an elongated twisted wire comprising a multiplicity of electrically conductive strands and having a generally circular cross section, an axis, and means defining at least one transverse aperture;

a connector of electrically conductive material and one-piece integral form positioned at said aperture and fastened to said wire, said connector comprising:

a center portion having a longitudinal axis, said connector being positioned wherein said center portion axis is substantially parallel to said wire axis and wherein said center portion has a surface which engages a first surface portion of said wire; and first and second wing portions integrally extending from said center portion, each of said wing portions being bent so as to crimpingly engage a second surface portion of said wire to securely fasten said connector to said wire, said first and second wing portions each comprising means defining a semicircular notch, said notches defining a second orifice when said wing portions are bent to engage said wire second surface portion, said second orifice being substantially coaxial with said aperture, wherein said connector defines a substantially rectilinear member having substantially planar opposed surfaces extending axially in opposite directions from said aperture.

2. The electrical harness of claim 1 wherein said connector further defines first and second side wall portions intermediate said center portion and said first and second wing portions.

3. The electrical harness of claim 1 wherein said center portion comprises means defining a first orifice, said connector being positioned wherein said orifice is substantially coaxial with said aperture.

4. The electrical harness of claim 1 wherein said center portion comprises means defining a plurality of slots, said slots defining a plurality of V-shaped tangs.

5. The electrical harness of claim 4 wherein said V-shaped tangs are bent into said aperture when said wing portions are bent to engage said wire second surface portion.

6. The electrical harness of claim 4 wherein said V-shaped tangs are bent to extend substantially perpendicular to said center portion surface whereby said aperture receives said V-shaped tangs when said connector is positioned at said aperture.

7. The electrical harness of claim 4 wherein said first and second wing portions each comprise means defining a plurality of slots, said slots forming a plurality of V-shaped tangs, wherein said V-shaped tangs are bent into said aperture when said wing portions are bent to engage said wire second surface portion.

8. An electrical harness comprising:

an elongated twisted wire comprising a multiplicity of electrically conductive strands and having a generally circular cross section and an axis;

a plurality of connectors composed of electrically conductive material, each of said connectors having a one-piece integral form, said connectors being positioned at substantially equidistantly spaced positions along said wire and fastened to said wire, said connector comprising:

a center portion having a longitudinal axis, said connector being positioned wherein said center portion axis is substantially parallel to said wire axis and wherein said center portion comprises a surface which engages a first surface portion of said wire and means defining a plurality of slots, said slots forming a plurality of V-shaped tangs;

first and second wing portions integrally extending from said center portion, each of said wing portions being bent so as to crimpingly engage a second surface portion of said wire with a surface of said first wing portion and a surface of said second wing portion to securely fasten said connector to said wire and wherein said connector defines a substantially rectilinear member having substantially planar opposed surfaces, said first and second wing portions each comprising means defining a plurality of slots, said slots forming a plurality of V-shaped tangs, and means defining an orifice extending through said wire and said connector, said orifice being substantially orthogonal to said wire axis, wherein said center portion V-shaped tangs are bent to extend from said center portion surface, said first wing portion V-shaped tangs are bent to extend from said first wing portion surface, and said second wing portion V-shaped tangs are bent to extend from said second portion surface wherein said V-shaped tangs displace said strands of said wire to define a side wall of said orifice means.

9. The electrical harness of claim 8 wherein said connector further defines first and second side wall portions intermediate said center portion and said first and second wing portions.

10. An electrical harness comprising:

an elongated twisted wire comprising a multiplicity of electrically conductive strands and having a generally circular cross section, an axis, and means defining at least one transverse aperture;

a connector of electrically conductive material and one-piece integral form positioned at said aperture and fastened to said wire, said connector comprising:

a center portion having a longitudinal axis, said connector being positioned wherein said center portion axis is substantially parallel to said wire axis and wherein said center portion has a surface which engages a first surface portion of said wire; and first and second wing portions integrally extending from said center portion, each of said wing portions being bent so as to crimpingly engage a second surface portion of said wire to securely fasten said connector to said wire, said first and second wing portions each comprising means defining a semicircular notch, said notches defining a second orifice when said wing portions are bent to engage said wire second surface portion, said second orifice being substantially coaxial with said aperture, wherein said connector defines a substantially rectilinear member having substantially planar opposed surfaces extending axially in opposite directions from said aperture, said connector and wire sandwiched to form a solid substantially rectangular mass.

11. The electrical harness of claim 10 wherein said connector further defines first and second side wall portions intermediate said center portion and said first and second wing portions.

12. The electrical harness of claim 10 wherein said center portion comprises means defining a first orifice, said connector being positioned wherein said orifice is substantially coaxial with said aperture.

* * * * *